US006471754B2

(12) United States Patent
Ammouri

(10) Patent No.: US 6,471,754 B2
(45) Date of Patent: Oct. 29, 2002

(54) PURIFICATION SYSTEM FOR TOBACCO-GENERATED SECONDHAND SMOKE

(76) Inventor: Tahsin Ammouri, 21927 Erie La., Lake Forest, CA (US) 92630

( * ) Notice: Subject to any disclaimer, the term of this patent is extended or adjusted under 35 U.S.C. 154(b) by 0 days.

(21) Appl. No.: 09/811,035

(22) Filed: Mar. 16, 2001

(65) Prior Publication Data

US 2002/0129710 A1 Sep. 19, 2002

Related U.S. Application Data

(60) Provisional application No. 60/236,131, filed on Sep. 28, 2000.

(51) Int. Cl.[7] ..... B03C 3/011

(52) U.S. Cl. ..... 96/58; 55/356; 55/385.8; 96/63; 96/87; 131/202; 131/333; 131/340; 131/342

(58) Field of Search ..... 96/55, 63, 97, 96/57, 58, 86, 87, 68; 55/385.8, 385.1, 356, 471; 131/202, 203, 207, 238, 339–342, 333

(56) References Cited

U.S. PATENT DOCUMENTS 3,807,148 A * 4/1974 Fike et al. ..... 55/385.8 X
4,177,045 A * 12/1979 Orel ..... 55/471 X
4,623,367 A * 11/1986 Paulson ..... 55/385.8
5,181,883 A * 1/1993 Hofstra et al. ..... 55/385.8 X
5,667,564 A * 9/1997 Weinberg ..... 96/97 X
5,707,429 A * 1/1998 Lewis ..... 96/63
5,779,769 A * 7/1998 Jiang ..... 96/63 X
6,039,776 A * 3/2000 Liue et al. ..... 55/385.8 X
6,156,088 A * 12/2000 Cardarelli ..... 96/55 X

* cited by examiner

*Primary Examiner*—Richard L. Chiesa
(74) *Attorney, Agent, or Firm*—Stetina Brunda Garred & Brucker

(57) ABSTRACT

A purification system for preventing secondhand tobacco smoke from reaching an ambient environment thereabout. Two components of the system include a smoke entrapment intake hood for aggregating the secondhand smoke and an electrostatic suction filter assembly in communication with the entrapment hood for extracting aggregated smoke from the hood, removing untoward particulate from the smoke, and releasing resulting clean air to the environment. The filter assembly includes at least one particulate filter for collecting smoke-borne particulate and at least one appropriately charged or grounded plate for electrostatically collecting charged smoke-borne particulate. An exit port from the filter assembly permits the release of so-cleaned air to the environment as a negative-ion emitter, positioned immediately inside the exit port, introduces charged ions into the cleansed air.

9 Claims, 3 Drawing Sheets

Fig. 1
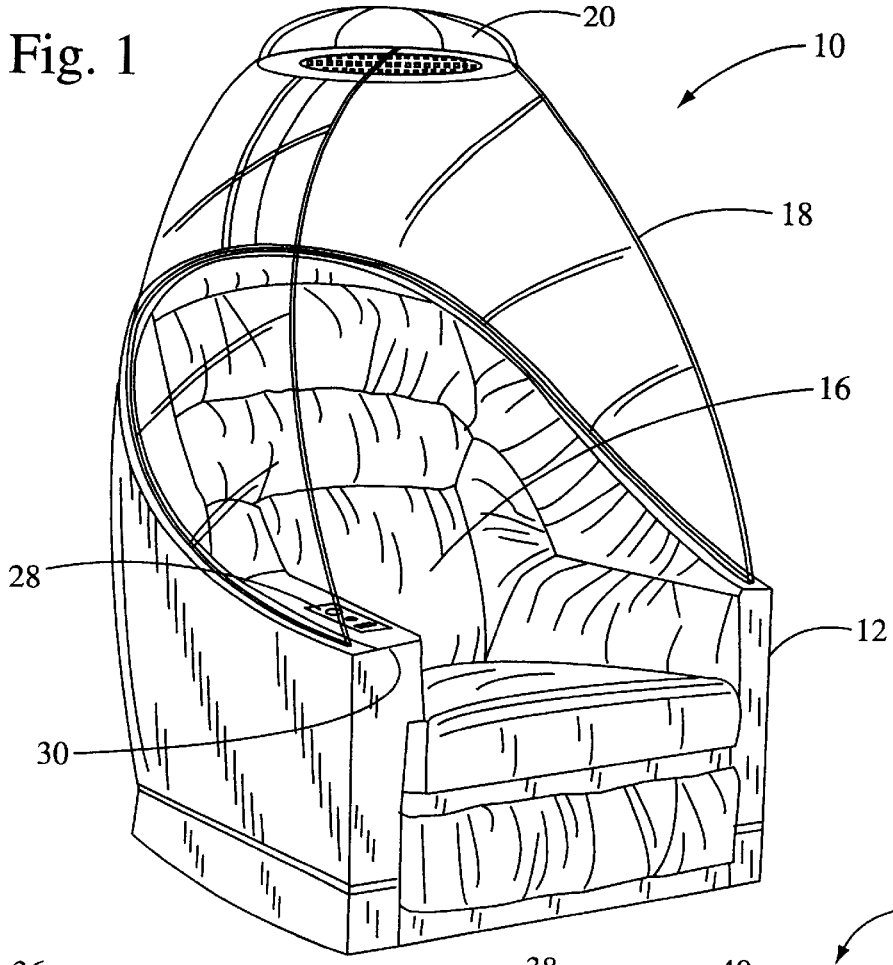
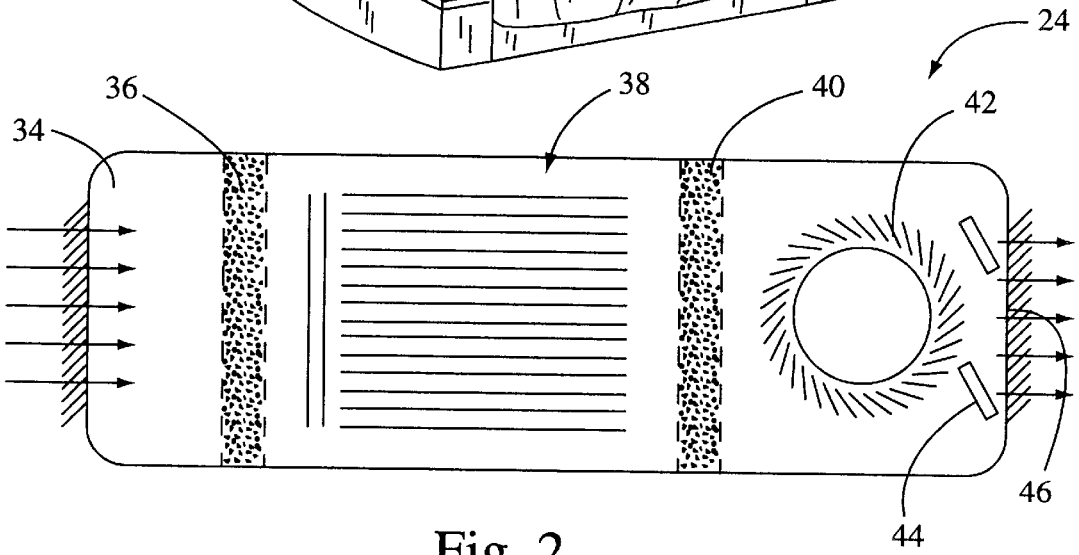
Fig. 2

PURIFICATION SYSTEM FOR TOBACCO-GENERATED SECONDHAND SMOKE

CROSS REFERENCE TO RELATED APPLICATIONS

This application claims the benefit of the filing date and disclosure of U.S. Provisional Patent Application Ser. No. 60/236,131, filed Sep. 28, 2000.

STATEMENT RE: FEDERALLY SPONSORED RESEARCH/DEVELOPMENT

Not Applicable

BACKGROUND OF THE INVENTION

The present invention relates in general to filtration systems, and in particular to a purification system for tobacco-generated secondhand smoke wherein a smoke entrapment intake hood and an electrostatic suction filter assembly concertedly first collect and clean tobacco-smoke saturated air and thereafter return clean air to the atmosphere.

While the hazards of cigarette, cigar, and pipe smoking to the smoker have been known for a relatively long time, the hazards of secondhand smoke, i.e. smoke emanating from the burning tobacco itself as well as that exhaled by the smoker and entering the ambient air, more recently have been recognized as a potential danger to non-smokers who are in the vicinity of the secondhand smoke. Especially vulnerable are children and anyone who has a respiratory or pulmonary disease since the inhalation of secondhand smoke is thought by some to be more dangerous than first-hand smoke inhaled by the smoker because the secondhand smoke has no benefit of filtration. Consequently, many establishments, as well as residences, have banned smoking altogether or have instigated requirements that limit smoking to a small area. Even with such limitations, however, the remnants of smoke as well as the potentially dangerous remaining particulate still can be present when smoking is permitted at a nearby site.

While It is apparent that a need is present for systems that can clean air containing secondhand smoke prior to air release into the ambient atmosphere, such recognition has resulted in little if any more than the availability of battery-powered ashtrays that pull smoke from a tobacco product such as a cigarette only while the cigarette is situated in a retainer clip of the ashtray. However, when the cigarette is being smoked, it is, of course, away from the ashtray and consequently is emitting secondhand smoke into the surrounding environment. Therefore, in view of the potential danger associated with secondhand smoke as generated from tobacco products, it is a primary object of the present invention to provide a purification system for such tobacco-generated secondhand smoke while the act of smoking occurs in a generally non-restricted location.

Another object of the present invention is to provide a purification system for tobacco-generated secondhand smoke whereby smoke-entrained air is collected and directed to a filtration appliance for decontamination and subsequent release of clean air to the ambient atmosphere.

Still another object of the present invention is to provide a purification system for tobacco-generated secondhand smoke where the tobacco smoker can be comfortably situated while persons in the immediate vicinity are not subjected to or bothered by such smoke.

These and other objects of the present invention will become apparent throughout the description thereof which now follows.

BRIEF SUMMARY OF THE INVENTION

The present invention is a purification system for preventing secondhand tobacco smoke from reaching an ambient environment thereabout. Two components of the system include, first, a smoke entrapment intake hood for aggregating the secondhand smoke, and, second, an electrostatic suction filter assembly in communication with the entrapment hood for extracting aggregated smoke from the hood, removing untoward particulate from the smoke, and releasing resulting clean air to the environment. The filter assembly includes at least one particulate filter for collecting smoke-borne particulate and at least one appropriately charged or grounded plate for electrostatically collecting charged smoke-borne particulate. An exit port from the filter assembly permits the release of so-cleaned air to the environment as a negative-ion emitter, positioned immediately inside the exit port, introduces charged ions into the cleansed air.

The present purification system can be provided in a variety of embodiments, including a chair structure, a gazebo structure, and a portable wheeled structure. In this manner, smokers, non-smokers, and the environment all benefit through convenient smoking sites that substantially do not emit or release secondhand smoke products into the atmosphere.

BRIEF DESCRIPTION OF THE DRAWINGS

An illustrative and presently preferred embodiment of the invention is shown in the accompanying drawings in which:

FIG. 1 is a perspective view of a secondhand tobacco smoke purification system incorporating a chair for use by a smoker;

FIG. 2 is a schematic view of a filter assembly of the purification system of FIG. 1;

DETAILED DESCRIPTION OF PREFERRED EMBODIMENTS

Figure 3:
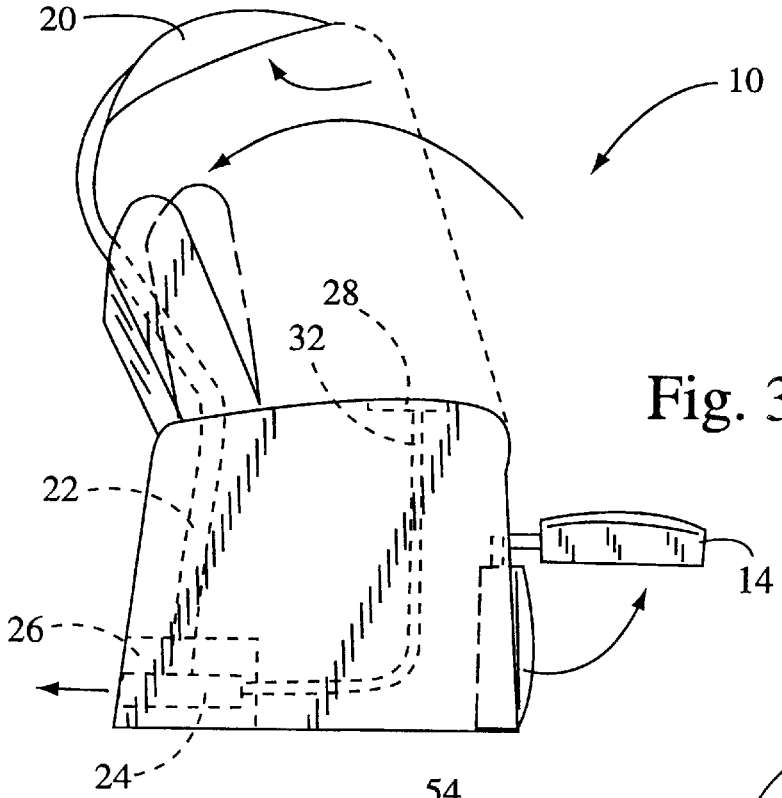
FIG. 3 is a side elevation view of the system of FIG. 1 showing chair characteristics.

Referring first to FIGS. 1 and 3, a first purification system 10 for preventing secondhand tobacco smoke from reaching an ambient environment thereabout is shown. The system 10 includes a chair 12 which can be reclineable and can provide a leg rest 14 as shown in FIG. 3 for an occupant. The chair 12 has a seating occupancy portion 16 with a transparent encasement structure 18 encircling at least about 50% of the occupancy portion 16. A smoke entrapment intake hood 20 for aggregating secondhand smoke produced by a smoker seated in the occupancy portion 16 is situated at the top of the encasement structure 18 and has a conduit 22 leading therefrom to an electrically powered electrostatic suction filter assembly 24 disposed in a compartment 26 of the chair 12. In like manner, an ashtray 28 disposed in an arm 30 of the chair 12 also has a conduit 32 leading to the filter assembly 24.

FIG. 2 clearly illustrates the electrostatic suction filter assembly 24. In particular, the assembly 24 provides, in sequence, an intake 34, a macro filter 36 for removing larger particulate, a series of electrically charged or grounded plates 38, a micro filter 40 (e.g. an activated carbon filter), a suction fan 42 for creating suction draw through the assembly 24, a negative ion emitter 44, and an exit port 46 leading to the ambient environment.

Figure 4:
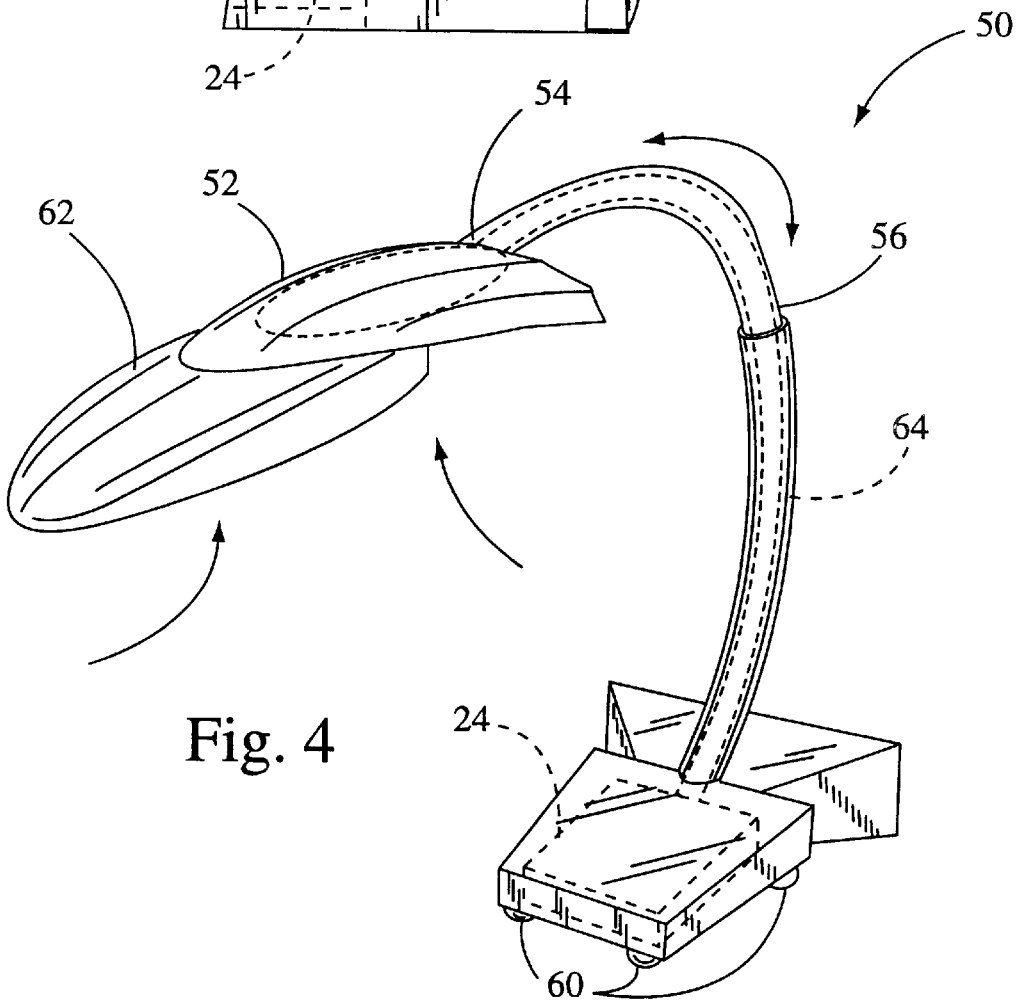
FIG. 4 is a perspective view of a second embodiment of a secondhand tobacco smoke purification system which is portable.

FIG. 4 illustrates a second embodiment of a purification system 50 for preventing secondhand tobacco smoke from reaching an ambient environment. The system 50 includes a smoke entrapment intake hood 52 mounted at the distal end 54 of an elongateable tubing neck structure 56 and extending from a mount 58 having wheels 60 to provide system portability. A hand-operable shutter 62 is provided for selective closing and opening of the hood 52. An electrostatic suction filter assembly 24 as above described is disposed within the mount 58 while a conduit 64 leads from the hood 52 through the neck structure 56 to the assembly 24.

Figure 5:
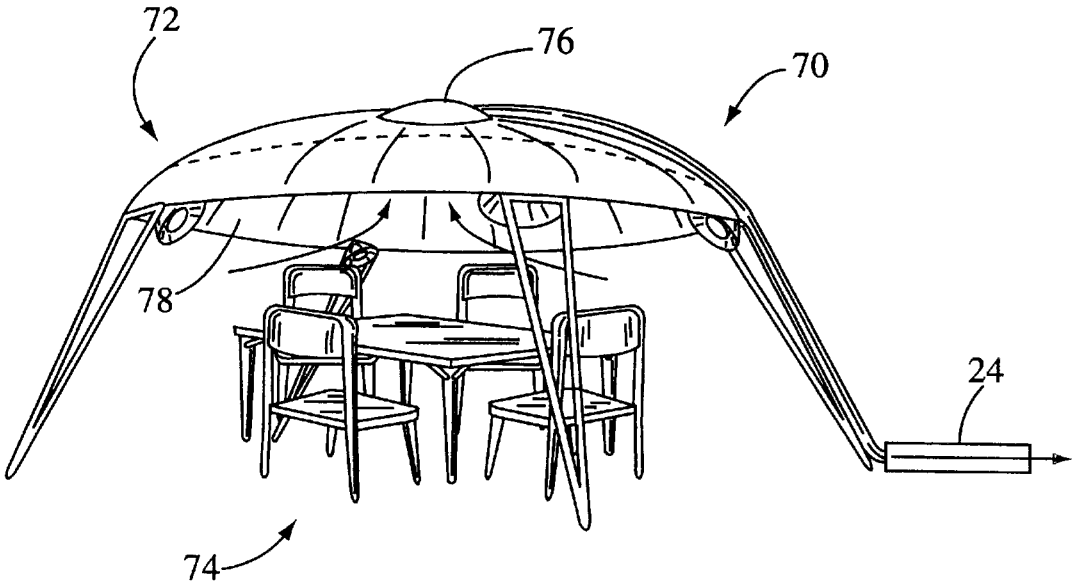
FIG. 5 is a perspective view of a third embodiment of a secondhand tobacco smoke purification system incorporating a gazebo structure.

FIG. 5 illustrates a third embodiment of a purification system 70 for preventing secondhand tobacco smoke from reaching an ambient environment. In particular, the system 70 includes a gazebo structure 72 within which a table and chairs 74 can be situated for indoor use. A smoke entrapment intake hood 76 for aggregating secondhand smoke produced by one or more smokers within the gazebo structure 72 is situated at the top center of the ceiling 78 thereof and has a conduit 80 leading therefrom to an electrostatic suction filter assembly 24 as above described.

The operation of all three embodiments is substantially identical. Specifically, secondhand tobacco smoke generated from a smoker who is situated beneath the smoke entrapment intake hood 20, 52, 76 is drawn by the suction fan 42 of the electrostatic suction filter assembly 24 in the direction exemplified by the respective arrows through the conduit 22, 64, 80 leading from the hood 20, 52, 76 to the intake 34, through the macro filter 36 for removing larger particulate, the series of electrically charged or grounded plates 38 for removing charged particles from the smoke, through the micro filter 40 for collection of escaped micro particulate, past the suction fan 42 and negative ion emitter 44 to and through the exit port 46 for returning clean air to the ambient environment. In this manner secondhand tobacco smoke is efficiently and effectively kept from entry into the environment while smokers can simultaneously co-exist with non-smokers at substantially the same site.

While an illustrative and presently preferred embodiment of the invention has been described in detail herein, it is to be understood that the inventive concepts may be otherwise variously embodied and employed and that the appended claims are intended to be construed to include such variations except insofar as limited by prior art.

What is claimed is:

1. A purification system for preventing secondhand tobacco smoke from reaching an ambient environment thereabout, the system comprising:

a) a smoke entrapment intake hood for aggregating the secondhand smoke; and b) an electrostatic suction filter assembly in communication with the entrapment hood for extracting aggregated smoke from said hood, removing untoward particulate from said smoke, and releasing resulting clean air to the environment, the filter assembly comprising:

i) at least one particulate filter for collecting smoke-borne particulate;

ii) at least one charged or grounded plate for electrostatically collecting charged smoke-borne particulate;

iii) an exit port through which clean air is released; and iv) a negative ion emitter positioned immediately inside the exit port for introducing charged ions into the cleansed air.

2. A purification system as claimed in claim 1 additionally comprising a chair with a seating occupancy portion and an encasement structure encircling at least about 50% of said occupancy portion, with said entrapment hood disposed inside the encasement structure.

3. A purification system as claimed in claim 2 wherein the encasement structure is transparent.

4. A purification system as claimed in claim 2 wherein the electrostatic filter assembly is disposed within a compartment of the chair.

5. A purification system as claimed in claim 2 wherein the chair additionally comprises at least one ashtray in communication with the filter assembly.

6. A purification system as claimed in claim 1 additionally comprising a gazebo structure with a roof structure in which the smoke entrapment hood is disposed.

7. A purification system as claimed in claim 1 additionally comprising a wheeled mount for portably moving the system.

8. A purification system as claimed in claim 7 wherein the intake hood is mounted at a distal end of a flexible tubing neck structure.

9. A purification system as claimed in claim 1 additionally comprising a hand-operable shutter for selectively blocking the intake hood.

* * * * *